US006761425B2

(12) United States Patent
Kawaguchi et al.

(10) Patent No.: US 6,761,425 B2
(45) Date of Patent: Jul. 13, 2004

(54) PRINTING APPARATUS AND PRINTING METHOD

(75) Inventors: Koichiro Kawaguchi, Kanagawa (JP); Haruyuki Yanagi, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/082,181

(22) Filed: Feb. 26, 2002

(65) Prior Publication Data

US 2002/0126192 A1 Sep. 12, 2002

(30) Foreign Application Priority Data

Feb. 28, 2001 (JP) ..... 2001-055561

(51) Int. Cl.[7] ..... B41J 29/38
(52) U.S. Cl. ..... 347/16; 347/19; 347/104
(58) Field of Search ..... 347/16, 19, 104; 400/708, 636; 399/16

(56) References Cited

U.S. PATENT DOCUMENTS 4,203,586 A * 5/1980 Hoyer ..... 271/34
4,723,129 A * 2/1988 Endo et al. ..... 347/56
5,368,403 A * 11/1994 Broder et al. ..... 347/104
5,480,247 A 1/1996 Saikawa et al. ..... 400/629
5,567,069 A 10/1996 Suzuki et al. ..... 400/636
5,602,571 A * 2/1997 Suda et al. ..... 347/104
5,982,400 A * 11/1999 Yokoi et al. ..... 347/104
6,092,892 A 7/2000 Taniguro et al. ..... 347/104
6,293,670 B1 9/2001 Taniguro et al. ..... 347/104
6,467,900 B1 * 10/2002 Askren et al. ..... 347/104

* cited by examiner

*Primary Examiner*—Thinh Nguyen
*Assistant Examiner*—Julian D. Huffman
(74) *Attorney, Agent, or Firm*—Fitzpatrick, Cella, Harper & Scinto

(57) ABSTRACT

A printing apparatus includes a printing section for performing a printing operation on a print medium and a sheet transporting section having a pair of opposite rollers that transport a print medium by rotating while sandwiching the print sheet therebetween. Further, a storage section stores positional information representative of the nip position at which an end of a print medium P is sandwiched between the pair of rollers.

27 Claims, 13 Drawing Sheets

NORMAL PRINTING

PRINTING AFTER PASS SWITCHING

PRINTING AFTER NOZZLE SHIFTING

PRINTING APPARATUS AND PRINTING METHOD

This application is based on Patent Application No. 2001-055561 filed Feb. 28, 2001 in Japan, the content of which is incorporated hereinto by reference.

BACKGROUND OF THE INVENTION

1. Field of the Invention

The present invention relates to a printing apparatus and method for a printer, a copy machine, facsimile terminal equipment, or the like, and specifically, to correction of the deviation of a printed position resulting from an error in transportation of a printing sheet.

2. Description of the Related Art

Conventional printing apparatuses such as printers, copy machines, and facsimile terminal equipment are equipped with a mechanism which transports a printing sheet as a printing medium. The mechanism includes a transportation roller, a pinch roller pressing the printing sheet against the transportation roller and holding the printing sheet between the pinch roller and the transportation roller, a device for causing the pinch roller to apply pressing force on the printing sheet, and other devices. Such transportation mechanism executes transporting operation for the printing sheet fed by a sheet feeding section, in a printing area by a printing head, and two pairs of such transportation mechanisms are generally provided before and behind the printing area, respectively. Thus, the printing sheet is precisely transported in the printing area, and during the transportation, predetermined tension is applied to the printing sheet to keep it flat over a wide area.

FIG. 12 is a sectional view mainly showing the transporting mechanism for the printing sheet in a conventional example of a printing apparatus based on an ink jet method.

In the figure, a printing head 7 mounted in a carriage portion 5 executes a scanning operation in a direction perpendicular to the drawing sheet, and during the scanning operation, ejects ink for performing a printing operation. In relation to the printing area covered by the printing head, a printing sheet P is transported, under the carriage portion 5, from right to left in the figure while substantially maintaining its horizontal orientation. More specifically, as the above-stated two pairs of transportation mechanisms, a pair of a transportation roller (hereinafter referred to as "LF roller") 36 and a pinch roller 37 is provided at an upstream side of the printing area, in which the printing sheet is transported, and a pair of a sheet discharging roller 41 and a spur 42 is provided at a downstream side of the printing area. Among these rollers, the pinch roller 37 is rotatably supported on a rotation shaft provided in a pinch roller holder 30. The pinch roller holder 30 is urged by a pinch roller spring 31 so that the pinch roller 37 can be pressed against the transportation roller 36. A pressing mechanism (not shown) similarly applies pressing force which is applied between the sheet discharging roller 41 and the spur 42. Thus, the print sheet is sandwiched between these two pairs of rollers. A motor (not shown) rotates the transportation roller 36, and rotationally drives the sheet discharging roller 41, which operates in connection with the transportation roller 36 via a predetermined gear train. Thus, the print sheet is transported a predetermined amount each time the print head performs a single scanning operation.

However, if the above-described transportation mechanism is used to transport the print sheet P, when the back end of the print sheet P slips out from between the transportation roller 36 and the pinch roller 37, the urging force of the pinch roller causes the print sheet P to be fed in the transporting direction. At this time, the LF roller and the sheet discharging roller may rotate a distance corresponding to the backlash of a gear train that drives these rollers, thereby causing the print sheet to be transported a distance larger than the intended predetermined value. In this case, the print head deviates from its regular position relative to the print sheet P, so that ink dots, formed on the print sheet P by ink ejected from the print head, may deviate from their intended positions. As a result, printed images and the like may be degraded.

FIGS. 13A and 13B show the positional relationship between the transportation roller 36 and the pinch roller 37. As shown in FIG. 13B, the transportation roller 36 has a length corresponding to the width of the transported print sheet P, whereas the pinch roller 37 comprises a plurality of shorter rollers disposed correspondingly to the transportation roller. With this construction, when the back end of the print sheet P slips out from between the transportation roller 36 and the pinch roller 37, the pinch roller 37 moves toward the transportation roller a distance corresponding to the thickness of the print sheet P, which has been sandwiched between the transportation roller 36 and the pinch roller 37. The urging force of the pinch roller associated with this movement causes the print sheet P to be transported an extra distance. Consequently, the print sheet P is transported a distance larger than the predetermined value. At the same time, the transportation roller rotates a corresponding distance.

To deal with such transportation errors, for example, a brake may be provided for rotation of the transportation roller so as to restrain the print sheet P from being transported an extra distance when slipping out from between the rollers. In this case, however, load torque required to drive the transportation roller increases, thus requiring the drive motor to be upgraded or the speed of transportation to be sufficiently increased.

SUMMARY OF THE INVENTION

The present invention is provided to solve these problems, and it is an object thereof to provide a printing apparatus and method which can promptly and properly correct the deviation of an image printed position caused by the behavior of a print sheet exhibited when its back end slips out from between a pair of rollers of a transportation means during transportation.

Thus, the present invention can have the following configuration:

A first aspect of the present invention is a printing apparatus having printing means that executes printing on a print medium transported along a transportation path, the apparatus being characterized by comprising upstream transporting means including a pair of opposite rollers arranged upstream of the printing means in the transportation path for transporting the print medium by rotating while sandwiching the print medium, downstream transporting means arranged downstream of the printing means in the transportation path for transporting the print medium, and storage means for storing nip position information representative of the position of a nip portion between the pair of rollers within the transportation path, the nip portion sandwiching an end of the print medium between the rollers.

Furthermore, a second aspect of the present invention is a printing method for executing printing on a print medium transported along a transportation path by using printing means, the printing method comprising the steps of transporting the print medium by upstream transporting means including a pair of opposite rollers arranged upstream of the printing means in the transportation path while sandwiching the print medium, transporting the print medium by downstream transporting means arranged downstream of the printing means in the transportation path, and storing nip position information representative of the position of a nip portion between the pair of rollers within the transportation path, the nip portion sandwiching an end of the print medium between the rollers.

With the above construction, according to the present invention, the storage means stores, as unique values for the printing apparatus, the accurate position of the nip between the pair of rollers of the transporting means for transporting the print medium while sandwiching it between the rollers. Accordingly, in a printing operation, this positional information can be used to promptly and precisely determine whether or not the back end of the print medium has slipped out from the nip portion, thereby allowing image corrections or the like to be executed on the back end of the print medium if it has slipped out from the nip portion. Consequently, high-grade printing results are obtained from all printing apparatuses without any variations. This further eliminates the need to improve transportation accuracy for print media by using a brake or the like to exert load torque on the transporting means, thereby providing an inexpensive small-sized printing apparatus.

The above and other objects, effects, features, and advantages of the present invention will become more apparent from the following description of embodiments thereof taken in conjunction with the accompanying drawings.

DETAILED DESCRIPTION OF PREFERRED EMBODIMENTS

Embodiments of the present invention will be described below in detail with reference to the drawings.

Embodiment 1

A printing apparatus according to this embodiment has an automatic sheet feeding unit installed therein, and in this state, has mechanism sections including the sheet feeding unit, a sheet transporting section, a sheet discharging section, a carriage section, and a cleaning section. Further, in addition to these mechanism sections, the printing apparatus is equipped with a control section in the form of a substrate which controls an operation of each mechanism section, described later, and which executes processing for printing data, transportation of a printing sheet or the like. The control section has a CPU, a ROM, a RAM and others as in a case with well-known printing apparatuses. Further, printing heads used in this printing apparatus are based on an ink jet method. Specifically, the printing heads employ what is called the BJ method which uses thermal energy generated by an electric-thermal transforming element to generate a bubble in ink to allow the ink to be ejected using pressure of the bubble.

Figure 1:
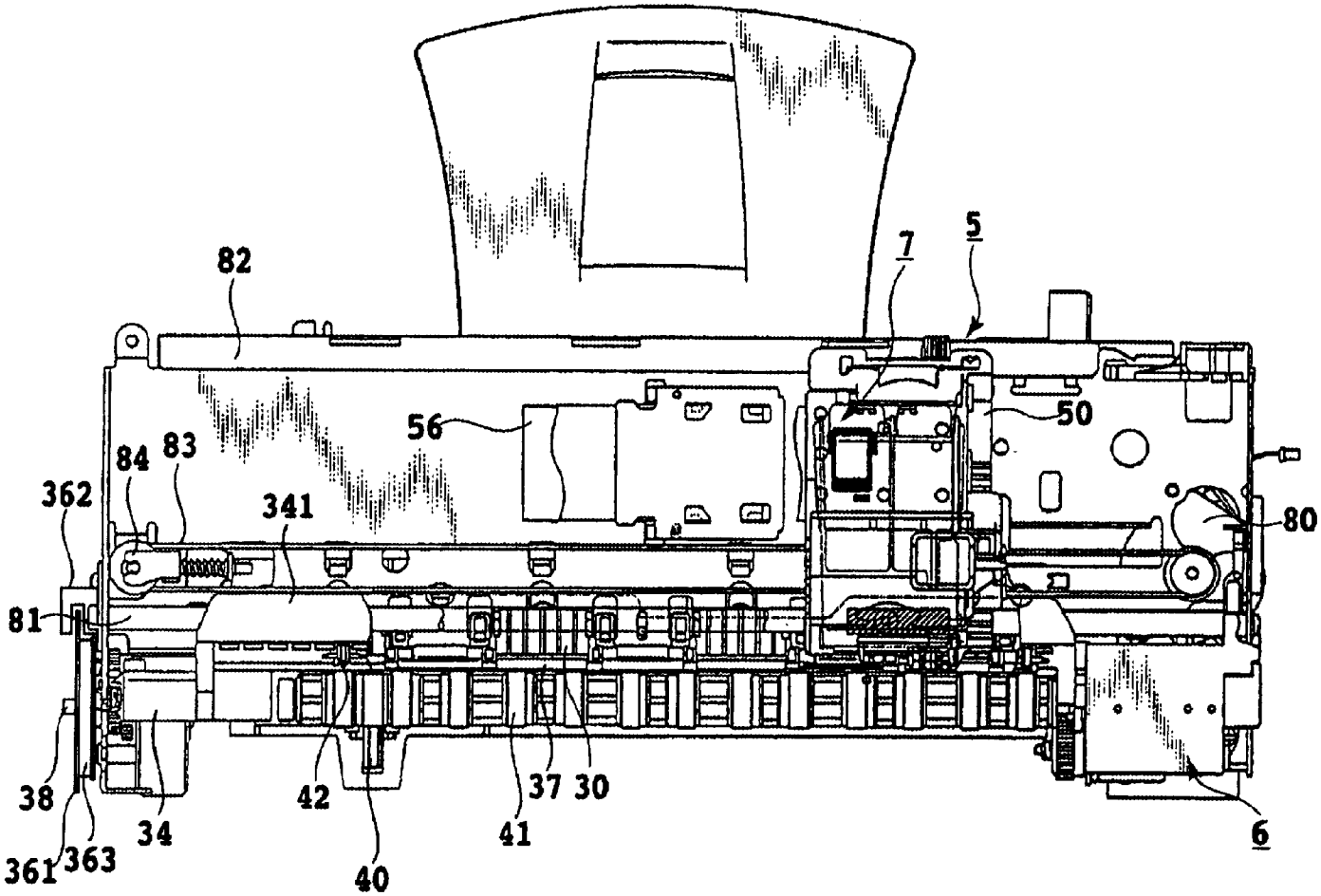
FIG. 1 is a front view of a printing apparatus according to a first embodiment of the present invention.
Figure 2:
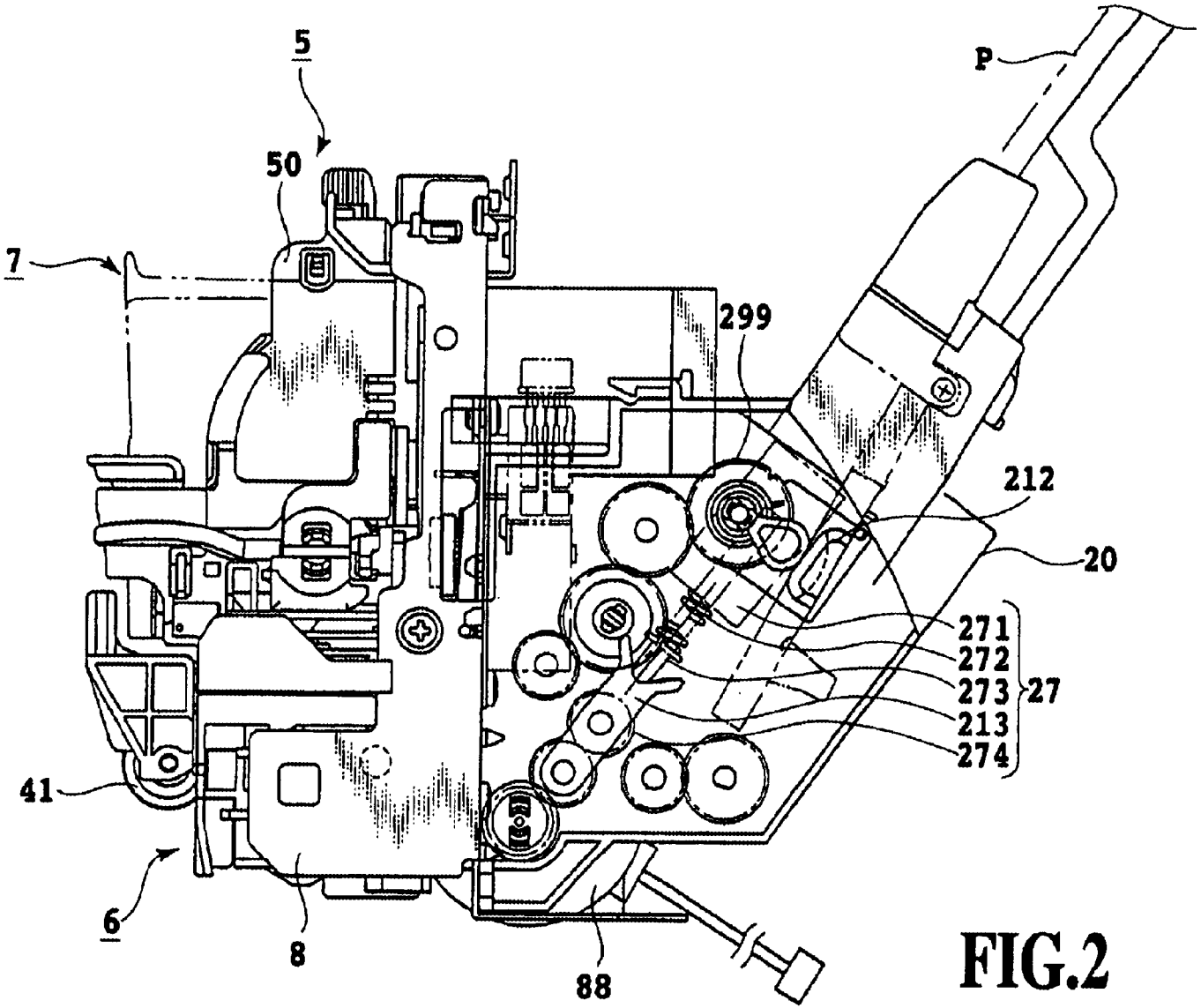
FIG. 2 is a side view of the printing apparatus.
Figure 3:
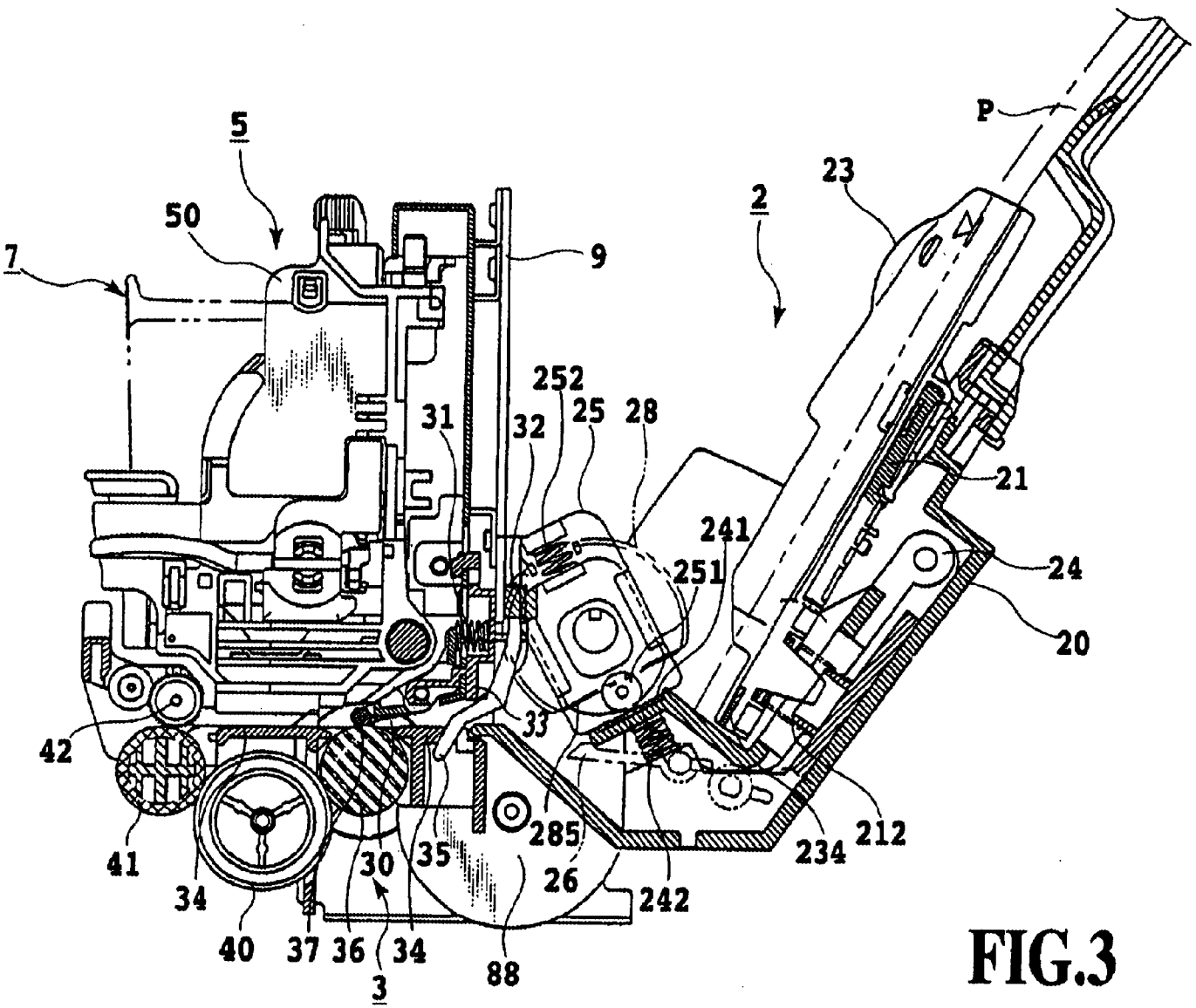
FIG. 3 is a vertical sectional side view of the printing apparatus.

The mechanism sections are shown in FIGS. 1 to 3. FIG. 1 is a front view of this printing apparatus, FIG. 2 is a side view thereof, and FIG. 3 is a traverse sectional view thereof. The above mentioned mechanism sections will be described below mainly with reference to the transverse sectional view of this printing apparatus shown in FIG. 3.

(A) Sheet Feeding Section (Sheet Feeding Unit)

In FIG. 3, the sheet feeding section 2 is constructed by installing the automatic sheet feeding unit in the printing apparatus main body. The automatic sheet feeding unit has a base 20, which is provided with a pressure plate 21 on which printing sheets P are loaded and a sheet feeding roller 28 that feeds the printing sheet P. The sheet feeding roller 28 has a D-shaped cross-section formed by partially cutting a circle. The pressure plate 21 is equipped with a movable side guide 23 that can restrict the loaded position of the printing sheets P. The pressure plate 21 is rotatable around a rotating shaft formed on the base 20 so that the urging force of a pressure plate spring 212 can urge the printing sheets P loaded thereon toward the sheet feeding roller 28. Further, the pressure plate 21 and the movable side guide 23 have separating pads 213 (see FIG. 2) and 234 installed in sites thereof opposite to the sheet feeding roller 28 to prevent a plurality of printing sheets P from being fed while overlapping each other, the separating pads being each composed of a material such as artificial leather which has a large friction coefficient.

Further, the base 20 is equipped with a separating pad holder 24 which is rotatable around the rotating shaft installed on the base 20 and which is equipped with a separating pad 241 to separate the printing sheets P from one another. The printing sheets P are urged toward the sheet feeding roller 28 by a separating pad spring 242. Further, against the separating pad holder 24, a rotating roller holder 25, which has a rotating roller 251 mounted thereon, is urged in the direction opposite to the above urging direction by a rotating roller spring 252.

The automatic sheet feeding unit is equipped with a release cam gear 299 (see FIG. 4) to release the contact of the pressure plate 21 (or the printing sheets P loaded thereon) with the sheet feeding roller 28. Rotation of the gear is set so that when the pressure plate 21 lowers to a predetermined position, a cut portion 285 of the sheet feeding roller 28 is located opposite the separating pad 241.

Thus, a predetermined space can be formed between the separating pad 241 and the sheet feeding roller 28. At the same time, the rotating roller 251 contacts with the separating pad 241 to prevent a plurality of printing sheets from being fed while overlapping each other.

As described above, in a standby state, the release cam gear 299 pushes the pressure plate 21 down to a predetermined position to clear the contact between the pressure plate 21 and the sheet feeding roller 28 and between the separating pad 241 and the sheet feeding roller 28. Then, in this state, when driving force applied to drive a transportation roller 36 of the sheet transporting section 3, described later, is transmitted to the sheet feeding roller 28 and the release cam 299 via a gear or the like, the release cam 299 leaves the pressure plate 21, which is thus elevated to cause the sheet feeding roller 28 to contact with the printing sheet P. As the sheet feeding roller 28 rotates, the printing sheets P are picked up and are then separated from one another by the separating pad 241 and fed to the sheet transporting section 3. Then, once the printing sheet P has been fed into the sheet transporting section 3, the contact of the sheet feeding roller 28 with both the pressure plate 21 and the separating pad 241 is cleared by the release cam gear. 299. Furthermore, once the fed printing sheet P has been completely printed and discharged, a return lever 26 acts on the printing sheets P placed on the separating pad 241 to allow the printing sheets P to be returned to their loaded position on the pressure plate 21.

The return lever 26 and the sheet feeding roller 28 are driven by driving force for the transportation roller 36 transmitted via predetermined gears. The transmission of the driving force is switched by a solenoid 271, solenoid spring 272, solenoid pin 273, and planetary gear arm 274 of a drive switching section 27 (see FIG. 2) More specifically, when the solenoid pin 273 acts on the planetary gear arm 274 to restrict its movement, the driving force for the transportation roller 36 is not transmitted. On the other hand, when the solenoid pin 273 is separated from the planetary gear arm 274, the planetary gear arm 274 becomes free to transmit the driving force to the return lever 26 and the sheet feeding roller 28 as the transportation roller 36 rotates forward or backward.

(B) Sheet Transporting Section

A chassis 8 (see FIG. 2) formed by bending a sheet metal and constituting a structural member of the printing apparatus main body has elements mounted thereon, which constitutes the sheet transporting section 3. More specifically, the sheet transporting section 3 is constructed by including a pair of the transportation roller 36 and a pinch roller 37, provided at an upstream side of the printing area covered by the printing head, in the transporting direction, and a pair of a sheet discharging roller 41 and a spur 42, provided at a downstream side of the printing area in the same direction. The transportation roller 36 is formed by coating the surface of a metal shaft with ceramic particles, and has shafts installed at the respective ends thereof and each supported by one of the two bearings 38 (One of them is shown in FIG. 1. The other is not shown) installed at the respective ends of a chassis 8.

A plurality of pinch rollers 37, which follow each other, are provided so that they can contact with the transportation roller 36. The pinch rollers 37 are held by a pinch roller holder 30, and when the holder is urged by a pinch roller spring 31, the pinch rollers 37 come into pressure contact with the transportation roller 36 to generate force required to transport the printing sheet P. At this time, a rotating shaft of the pinch roller holder 30 is mounted on a bearing of an upper guide 33 installed on the chassis 8, and the pinch roller holder 30 rotates around this shaft. The pinch roller holder 30 is integrally formed and has fixed or higher rigidity in a direction in which the printing sheets P are transported. By further setting relatively low rigidity in a direction perpendicular to the above transportation direction, the urging force of the pinch roller spring 31 appropriately acts on the pinch rollers 37. Further, all the pinch rollers 37 are constructed substantially parallel with the rotating shaft of the transportation roller 36 (see FIG. 1) as described above. The pinch roller holder 30 and the upper guide 33 also act as a guide for the printing sheets P. Furthermore, an inlet of the sheet transporting section 3, to which the printing sheet P is transported from the above-described sheet feeding portion 2, has a platen 34 disposed thereat to guide the printing sheet P. Further, the upper guide 33 is equipped with a PE sensor lever 35 that activates a PE sensor 32 for detecting front and back ends of the printing sheet P. Additionally, the platen 34 is mounted and positioned on the chassis 8. The pinch rollers 37 according to this embodiment are formed of resin such as POM which allows an object to slide well thereon, and each has an outer diameter set between about $\phi 3$ and 7 mm.

Further, the platen 34 has a sheet presser (not shown) installed on a sheet reference side thereof and which covers the corresponding end of the printing sheet P. Thus, even if the end of the printing sheet P is deformed or curved, it is prevented from floating to interfere with a carriage 50 or printing heads 7.

A carriage portion 5, described later, is constructed above the sheet transporting section 3. The carriage portion has the printing heads 7 mounted thereon and which perform a scanning operation to eject ink to the printing sheet P for printing, the printing sheet P being transported by the pair of the transportation roller 36 and the pinch roller 37 and the pair of the sheet discharging roller 41 and the spur 42. In this printing operation, the printing sheet P that has been fed to the sheet transporting section 3 is guided to the pair of the transportation roller 36 and the pinch roller 37 by the platen 34, the pinch roller holder 30, and the upper guide 33. At this time, the PE sensor lever is operated by the front end of the transported printing sheet P, to detect the front end of the printing sheet P. Then, based on the result of the detection, a printing position on the printing sheet P can be determined. Further, an LF motor 88 drives and rotates the pair of the rollers 36 and 37 to transport the printing sheet P on the platen 34, and the transportation roller 36 has an encoder wheel 361 (see FIG. 1) mounted thereon to detect the rotary position thereof. The encoder wheel 361 is composed of a disk-shaped transparent sheet having radial markings formed thereon at predetermined pitches. The rotary position or quantity of rotation of the transportation roller 36 can be determined an optical encoder sensor 362 (see FIG. 1) fixed to the chassis 8 detects these marks.

The carriage portion 5, as described before, has the printing heads 7 and ink tanks from which black and color inks are supplied to the printing heads 7, which are individually arranged for the respective ink colors and individually detachable from the carriage. Also as described above, the printing head 7 has a heater to heat the ink so that film boiling is caused in the ink to generate a bubble, and change in pressure caused by growth or contraction of the bubble causes the ink to be ejected from the nozzles of the printing heads 7. Thus, printing of an image on the printing sheet P can be performed. The printing heads 7 for the respective color inks have the nozzles, constituting printing elements, arranged parallel with the direction in which the printing sheet is transported. Thus, inoperative nozzles can be set and this setting can be used to execute corrections according to an error in transportation of the printing sheet, as described later with reference to FIGS. 6B and 6C.

(C) Carriage Portion

The carriage portion 5 has a carriage 50, to which the printing heads 7 are mounted. The carriage 50 is supported by a guide shaft 81 (see FIG. 1) extending in the direction perpendicular to the direction in which the printing sheet P is transported and a similarly extending guide rail 82 (see FIG. 1) that holds a rear end of the carriage 50 to maintain a gap between the printing heads 7 and the printing sheet P.

Further, the carriage 50 is driven by a carriage motor 80 (see FIG. 1), which is mounted on the chassis 8, via a timing belt 83 (see FIG. 1). The timing belt 83 is extended and supported by idle pulleys 84 (see FIG. 1). Furthermore, the carriage 50 is equipped with a flexible substrate 56 (see FIG. 3) to transmit printing signals or the like, from an electric substrate 9 constituting the above-described control section, to the printing heads 7.

With the above configuration, for printing on the printing sheet P, the pair of the rollers 36 and 37 transports the printing sheet P to a row position to be printed (a position on the printing sheet P in the transportation direction), and the carriage motor 80 moves the carriage 50 to a column position to be printed (a position on the printing sheet P in the direction perpendicular to the transportation direction, to scan the printing heads 7 on the printing sheet. Then, during this scanning operation, on the basis of printing signals or the like from the control section, the printing heads 7 are driven to eject the ink to the printing sheet P, thereby printing the image or the like.

(D) Sheet Discharging Section

The pair of the sheet discharging roller and spur in the sheet transporting section constitute a sheet discharging section. More specifically, a spur base 341 (see FIG. 1) has the spurs 42 rotatably provided therein correspondingly to the sheet discharging rollers 41 and against which the spurs are contacted. The sheet discharging rollers 41 can be driven by a transmission roller 40 transmitting driving force for the transportation roller 36 to the sheet discharging roller.

The sheet discharging rollers 41 are formed as a plurality of roller portions, each of which is made of a high-friction material such as rubber, and is disposed on a shaft consisting of metal or resin (see FIG. 1). Further, each of the spurs 42 has a thickness of about 0.1 mm, has promotions formed on its outer circumference, and is composed of a metal plate such as SUS (stainless steel) and a resin portion consisting of POM and forming a rotating bearing.

The transmission roller 40, which transmits driving force to the sheet discharging roller 41, is disk shaped, is composed of POM or the like, and has a low-hardness and high-friction material such as styrene-based elastomer attached on the outer circumference thereof. The transmission roller 40 is contacted against both the transportation roller 36 and the sheet discharging roller 41 at a predetermined pressure, thereby transmitting driving force therebetween.

With the above configuration, the printing sheet P on which printing has been carried out through a scanning operation of the printing heads of the carriage portion 5 is transported while being held by nipping of the sheet discharging roller 41 and spur 42, and is then discharged to a sheet discharging tray or the like. During this transportation, once the back end of the printing sheet P has slipped out from the transportation roller 36 and the pinch roller 37, the printing sheet P is transported or discharged while being held only by the sheet discharging roller 41 and spur 42 of the sheet discharging section. Then, a printing operation is performed or the printing sheet is discharged. Further, a spur cleaner contacts each of the spurs 42 to enable ink and the like deposited on the spur 42 to be removed.

(E) Cleaning Section

A cleaning section 6 (see FIGS. 1 and 2) has a pump (not shown) used for an ejection recovery operation for the printing heads 7 and a cap (not shown) that restrains the ink in each nozzle of the printing head from drying.

Figure 4:
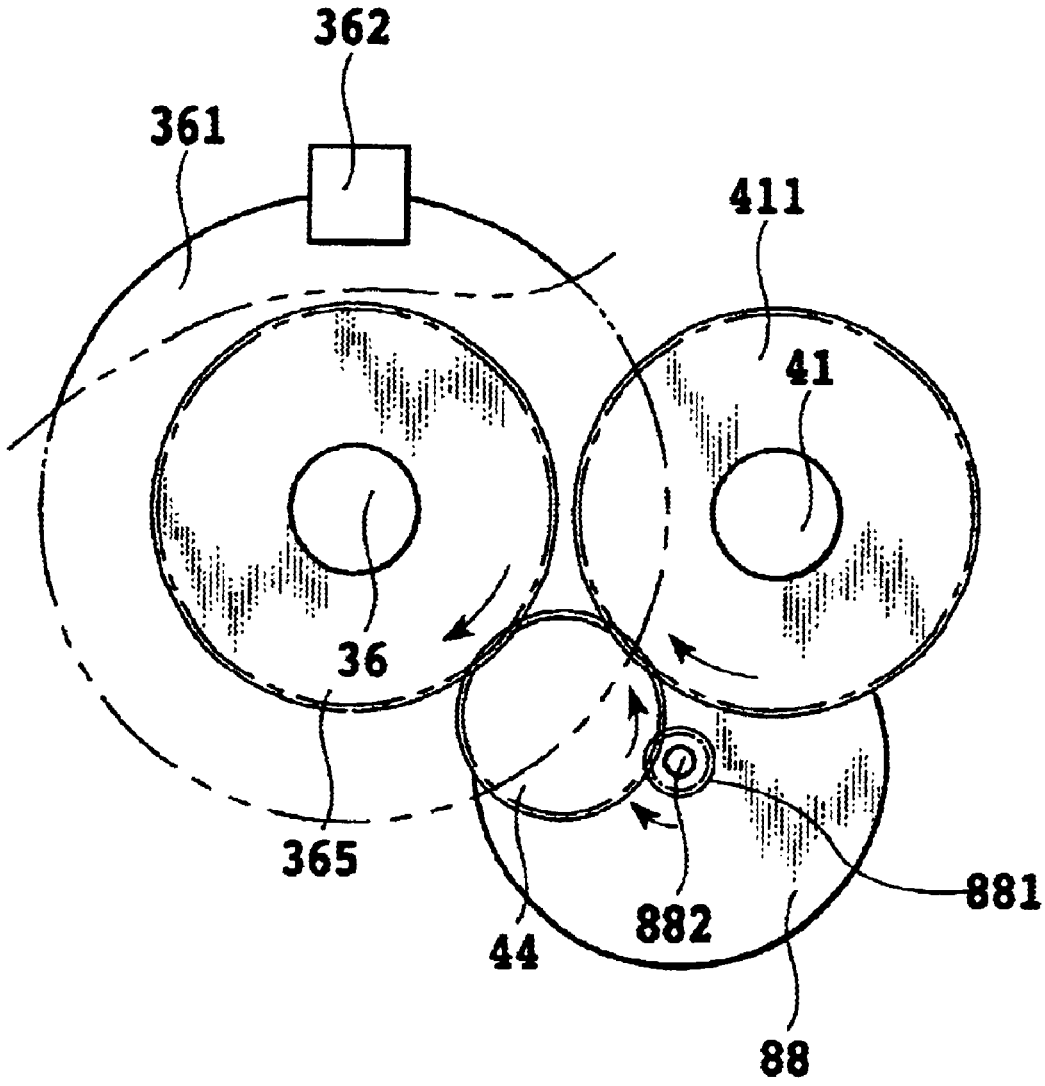
FIG. 4 is a view showing a mechanism of transmitting drive force between a transportation roller and a sheet discharging roller according to the first embodiment of the present invention.

FIG. 4 is a view useful in describing a detection mechanism that detects a rotary position or quantity of rotation of the transportation roller 36.

As described above, the transportation roller 36 has an encoder wheel 361 mounted thereon. Specifically, the encoder wheel 361 can be centered by press fitting it to the rotating shaft of the transportation roller 36, and is bonded to an LF pulley 364 to increase its strength. The encoder wheel 361 is, as shown in FIG. 4, a disk-shaped, transparent sheet, and has radial markings formed thereon at predetermined pitches. With respect to the encoder wheel, an optical encoder sensor 362 is provided in a fixed state for detecting the markings on the encoder wheel 361 to determine the rotary position or quantity of rotation of the transportation roller 36. That is, each time any of the marks on the encoder wheel 361 reaches the position of the encoder sensor 362 as the transportation roller 36 rotates, a corresponding detection signal is generated and transmitted to the control section. The control section counts the number of detection signals starting with a predetermined reference rotary position to determine the rotary position or quantity of rotation of the transportation roller 36. Further, the transportation roller 36 can be driven by transmitting the drive force of the LP motor 88 via a gear train.

That is, as shown in FIG. 4, the transportation roller 36 has an LF gear 365 attached thereto, and the sheet discharging roller 41 has a sheet discharging roller gear 411 attached thereto. Both the LF gear 365 and the sheet discharging roller gear 411 mesh with the sheet discharging idler gear 44. Furthermore, the sheet discharging idler gear 44 has an LF motor gear fixed to a rotationally moving shaft 882 of the LF motor and meshing with the idler gear 44.

A printing operation performed by the above-described printing apparatus of this embodiment, particularly an image position correcting operation, will be described with reference to FIGS. 5 and 6.

Figure 5:
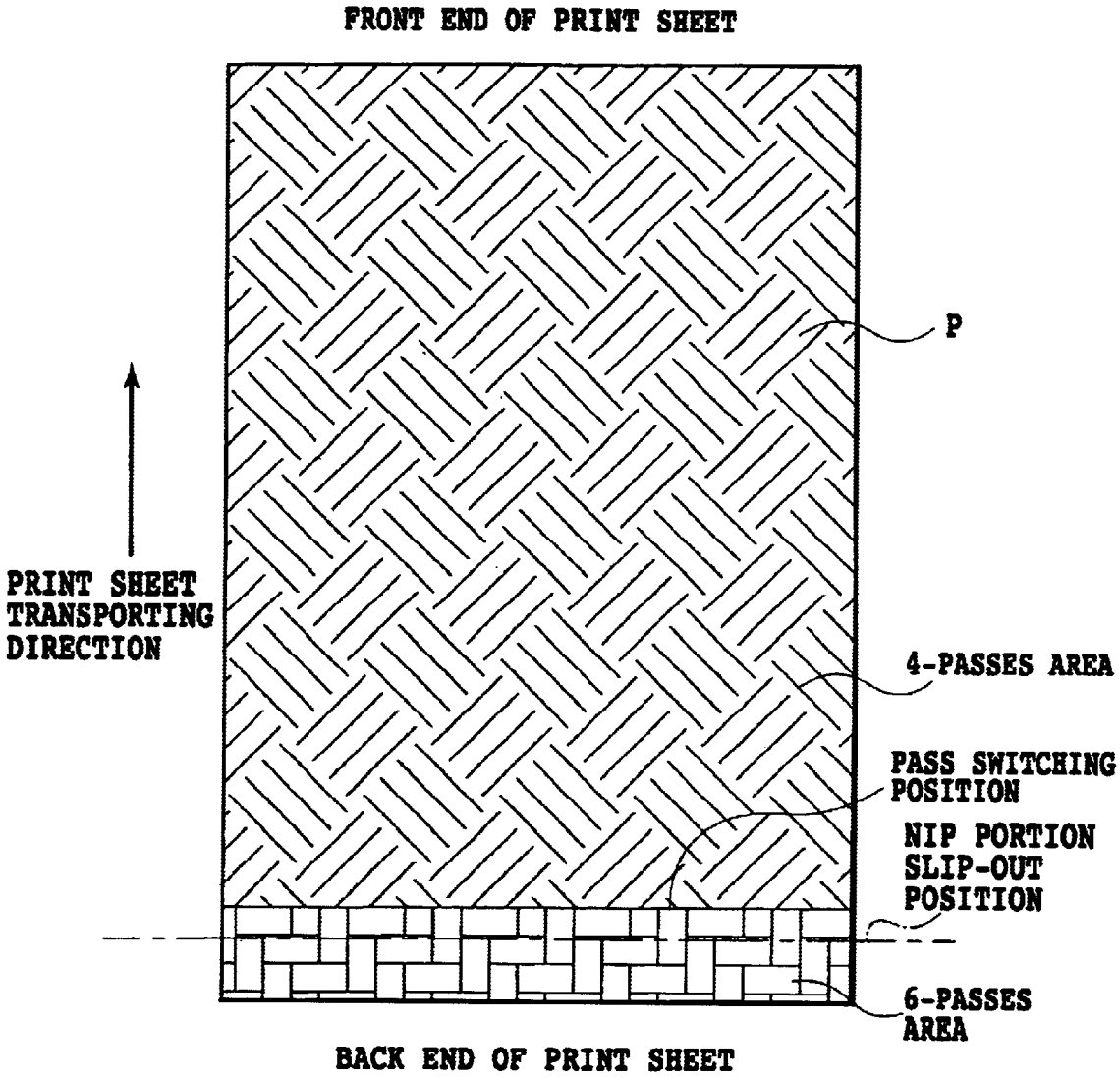
FIG. 5 is a view showing printing control in the first embodiment of the present invention, on the basis of print areas of a print sheet.
Figure 6A:
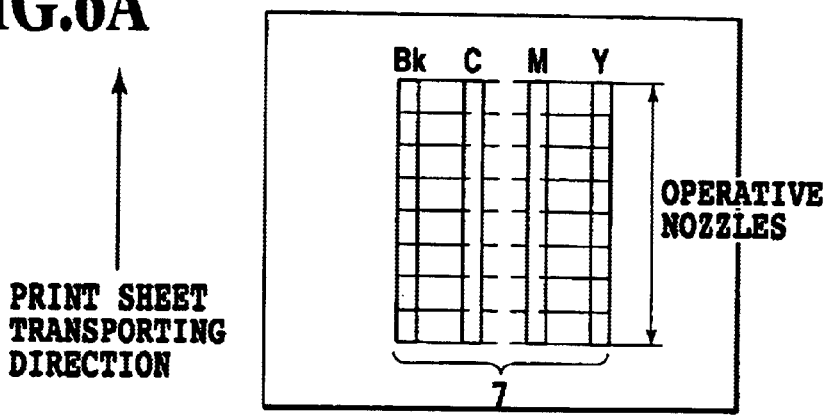
FIGS. 6A to 6C are views illustrating the printing control for each print area.
Figure 6B:
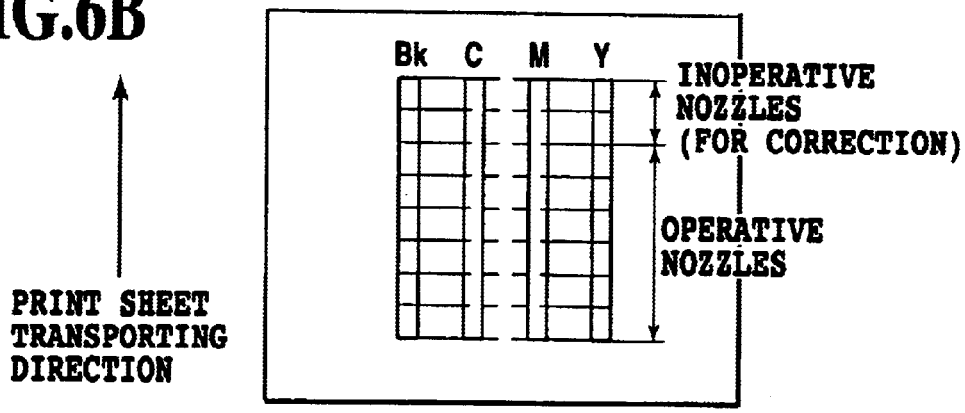
Figure 6C:
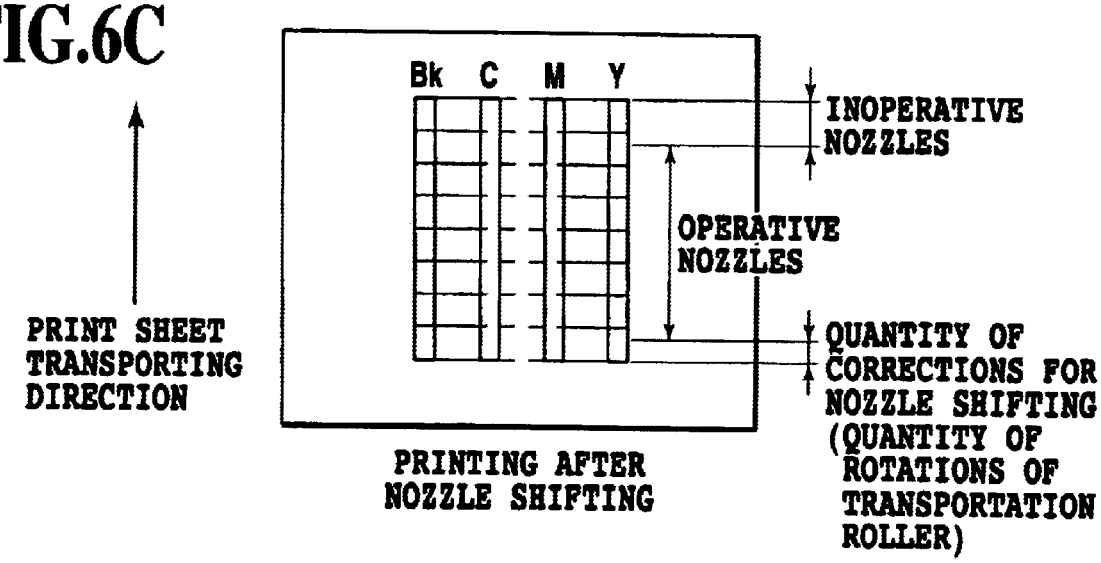

FIG. 5 illustrates that different printing control operations are performed for the respective areas of the print sheet FIGS. 6A to 6C show the range of operative nozzles (nozzles that are used) in the print head for each printing control operation.

In this embodiment, what is called multipass printing is carried out in which a print area printed by causing the print head to perform a scanning operation is printed by a plurality of scanning operations and in which different nozzles are used for each scanning operation. For this multipass printing, this embodiment uses an area that is entirely printed using four scanning operations (4-pass areas) and an area that is entirely printed using six scanning operations (6-pass areas), as shown in FIG. 5. That is, for a 4-pass area, normal printing is executed on the corresponding area using four nozzle blocks obtained by dividing all the nozzles of the print head into four groups as shown in FIG. 6A. For a 6-pass area, printing is basically executed after pass switching, using six nozzle blocks obtained by dividing six-eighths of all the nozzles into six groups as shown in FIG. 6B.

While the print sheet P is being transported, its back end slips out from between sheet sandwiching sections (nip portion) of the upstream transportation roller and pinch roller, and is then transported by only the pair of the downstream sheet discharging roller and spur. In this case, since transportation with only the single pair is less accurate than transportation with both the upstream and downstream pairs, the quantity of transportation per operation is reduced to lessen possible errors. At the same time, the number of scanning operations for the same print area for multipass printing is increased to make possible non-uniform density unnoticeable, the non-uniform density resulting from the above-mentioned errors. Thus, in this embodiment, for the 6-pass area set for the back end of the sheet, the quantity of transportation per operation is shorter than that for the 4-pass area, and six passes are used.

While the print sheet P is being transported, the above-mentioned pass switching is carried out when an image forming position reaches a "pass switching position", shown in FIG. 5. At this point of time, the print sheet P is sandwiched between the transportation roller 36 and the pinch roller 37. To allow image corrections to be executed at a "nip portion slip-out position", the pass switching must be carried out before the "nip portion slip-out position" is reached, in order to set correction nozzles on the downstream side of the print sheet in the transportation direction. Then, as described below, image corrections are executed on the basis of nip position information, described later, stored in the storage means. Subsequent printing operations are performed after nozzle shifting as shown in FIG. 6C.

During the normal printing shown in FIG. 6A, print heads 7 for black (Bk), cyan (C), magenta (M), and yellow (Y) each use all nozzles. Further, since the 4-pass printing is carried out, the quantity of transportation for the print sheet P per operation equals one-fourth of the total length of the nozzles. Then, this print area of the one-fourth width is entirely printed by causing the print heads to perform four scanning operations. This 4-pass area is entirely printed by executing the 4-pass printing while the print sheet P is being transported until the "pass switching position" of the print sheet P is reached. At the final stage of the printing of the 4-pass area, some nozzles of each print head are located opposite a 6-pass area. However, at this stage, the operative nozzles are shifted a distance corresponding to the quantity of transportation per operation to complete printing the 4-pass area without using the nozzles of each print head located opposite the 6-pass area. The switching of the number of passes is controlled in the above manner in order to simplify software, and it should be appreciated that the switching process is not limited to the above example.

Once the 4-pass area has been entirely printed, "printing after pass switching", shown in FIG. 6B, is carried out, that is, the 4-pass printing operation is switched to a 6-pass printing operation. With this printing operation, some of the nozzles of each print head 7 are set as inoperative nozzles as shown in FIG. 6B. In this embodiment, two-eighths of the nozzles are set to be inoperative, while the remaining six-eighths are used for printing. Since the latter nozzles are used for the 6-pass printing, the quantity of transportation for the print sheet P per operation equals one-eighth of the length of the entire nozzle range.

In this 6-pass printing area, when the back end of the sheet slips out from the nip portion between the transportation roller 36 and the pinch roller 37, the urging force of the pinch roller may cause the sheet to be fed, thereby rotating the transportation roller 36 and the sheet discharging roller 41 a distance corresponding to backlash set for the above-mentioned gear train. In this case, if the printing is continued without any corrections, the image on the sheet deviates significantly from its correct position, and is disadvantageously degraded. Thus, in this first embodiment, immediately after the back end of the print sheet P has slipped out from the nip portion between the transportation roller 36 and the pinch roller 37 and has thus been released therefrom, the printing operation is corrected in the manner described below to form an appropriate printed image.

This correcting operation will be described in conjunction with FIGS. 6A to 6C and 7.

Figure 7:
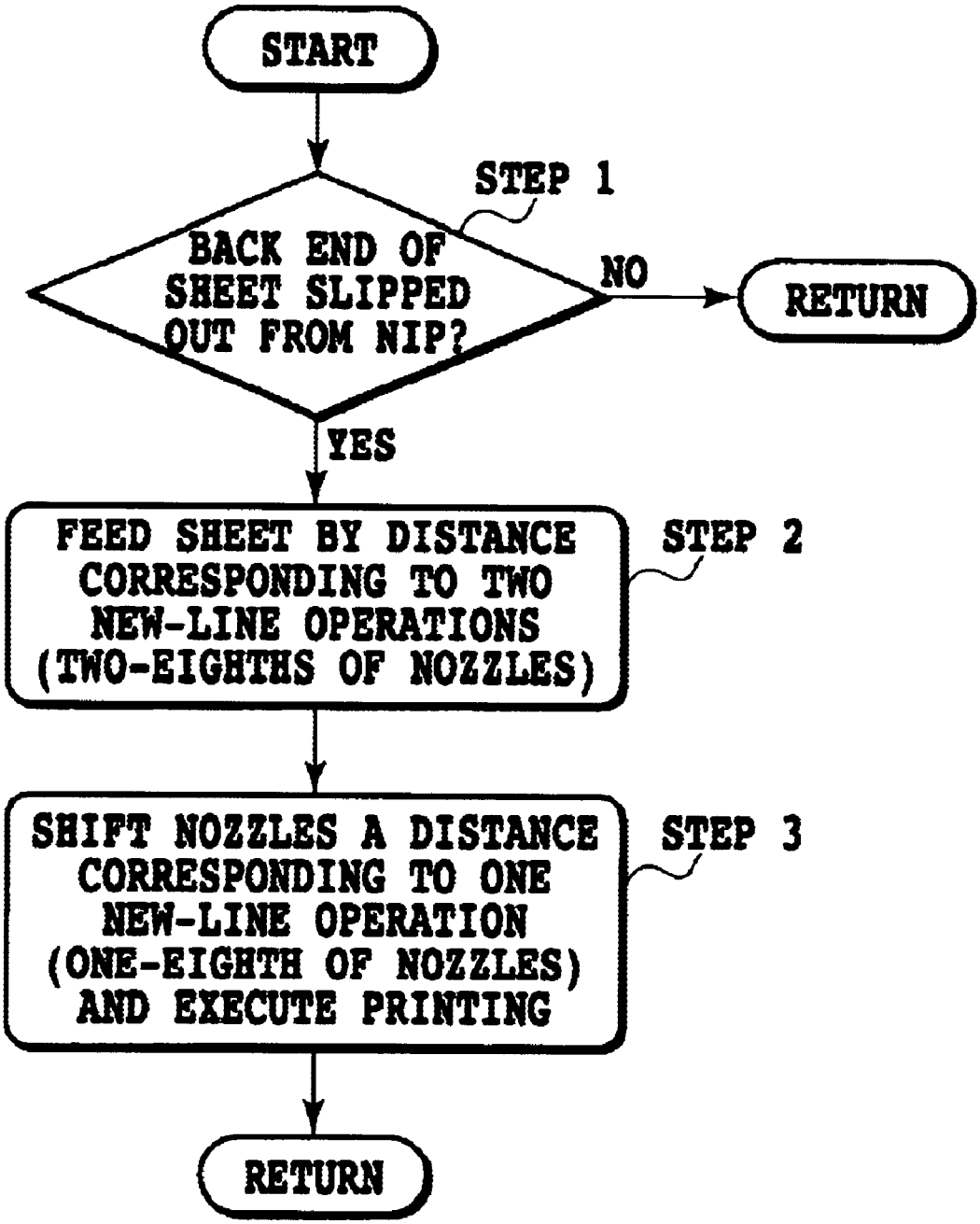
FIG. 7 is a flow chart showing the procedure of a correcting operation performed when the back end of a print sheet has slipped out from a nip according to the first embodiment of the present invention.

As shown in FIG. 7, during the printing operation, the control section determines the quantity of rotations of the transportation roller 36, on the basis of a signal from the encoder sensor 362. The control section also determines whether or not the back end of the print sheet P has been released from the nip portion between the transportation roller 36 and pinch roller 37, on the basis of the nip position information, described later, already stored in the storage means (step 1). If the control section determines that the back end has slipped out from the nip portion, the quantity of transportation for the print sheet P per operation, which quantity is used immediately after the determination, is set twice the quantity of transportation for the 6-pass printing (that is, the quantity equaling one-eighth of the length of the nozzle range), that is, the quantity is set to correspond to two-eighths of the all the nozzles (corresponding to two new-line operations).

In response to the increase in the quantity of transportation by a value corresponding to one-eighth of the nozzles immediately after the back end has slipped out from the nip, the operative nozzles of each print head 7 are shifted a distance corresponding to one-eighth of the nozzles, using the inoperative nozzles shown in FIG. 6C. As a result, the positions of dots ejected onto the print sheet are corrected so as to be shifted a distance corresponding to one-eighth of the nozzles, in the transportation direction, thereby enabling an image to be properly formed on the print sheet without any deviations.

That is, if the sheet is transported a distance corresponding to one-eighth of the nozzles immediately after the back end of the print sheet P has slipped out from the nip portion, the urging force of the pinch roller may cause the print sheet P to be transported an extra distance corresponding to the backlash of the LF gear 365, sheet discharging roller gear 411, sheet discharging idler gear 44, LF motor gear 881, and others, in addition to the quantity of transportation corresponding to one-eighth of the nozzles. Thus, the print sheet P cannot be precisely stopped at the correct position. Accordingly, under these conditions, no printing operation is performed, but the print sheet is further transported a distance corresponding to one-eighth of the nozzles to accommodate the deviation of the position of the back end resulting from the backlash of the gear train. Then, the back end of the sheet is precisely stopped after the sheet has been transported a distance corresponding to an integral multiple (in this case, twice) of one-eighth of the nozzles, from the nip position, and the range of operative nozzles is shifted a distance corresponding to two-eighths of the nozzles. This enables dots to be precisely formed on the print sheet P.

In this first embodiment, the backlash of the gear train is set such that a possible error in transportation corresponds to less than one-eight of the nozzles. Thus, by transporting the print sheet a distance corresponding to one-eighth of the nozzles, all transportation errors resulting from the backlash can be accommodated.

Figure 8:
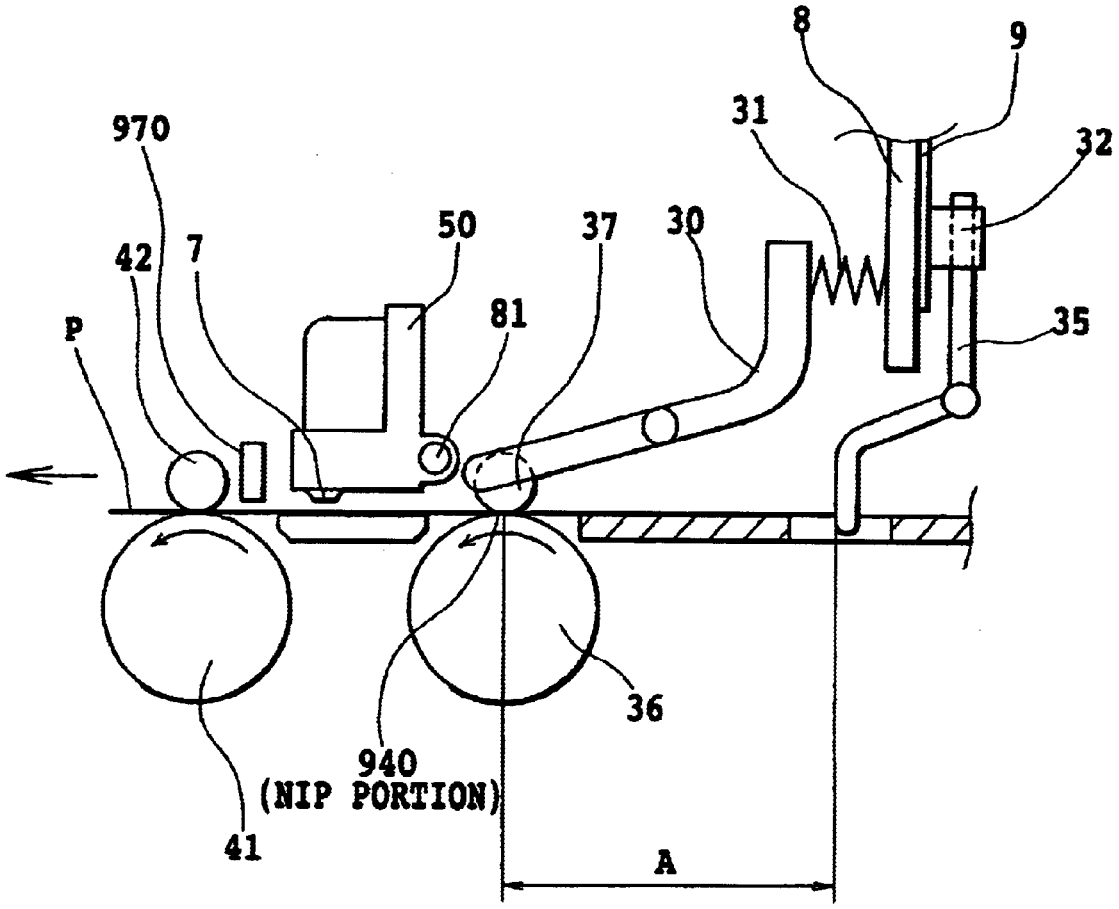
FIG. 8 is a side view schematically showing the construction of the first embodiment of the present invention.

For the above-described correcting operation, it is important to precisely determine whether or not the back end of the print sheet P has slipped out from the nip portion. To achieve this, the position of the nip portion in the transportation path must be precisely determined. Typically, as shown in FIG. 8, the position of the PE sensor lever 35, provided in the transportation path, is set as a reference so that the position of a nip portion 940 is determined on the basis of the distance A (FIG. 8) from the reference position to the nip portion 940.

In performing an image correcting operation, the print sheet is transported at a very low speed in order to reduce variations in the operation of the PE sensor lever 35. If no image correcting operation is performed, the print sheet need not be transported at a low speed because the top priority must be given to an increase in printing speed.

In this embodiment, when the PE sensor detects the back end of the print sheet, the speed of transportation is set at 20 mm/s for the image correcting operation and at 50 to 150 mm/s for the operations other than the image correcting operation.

Figure 9:
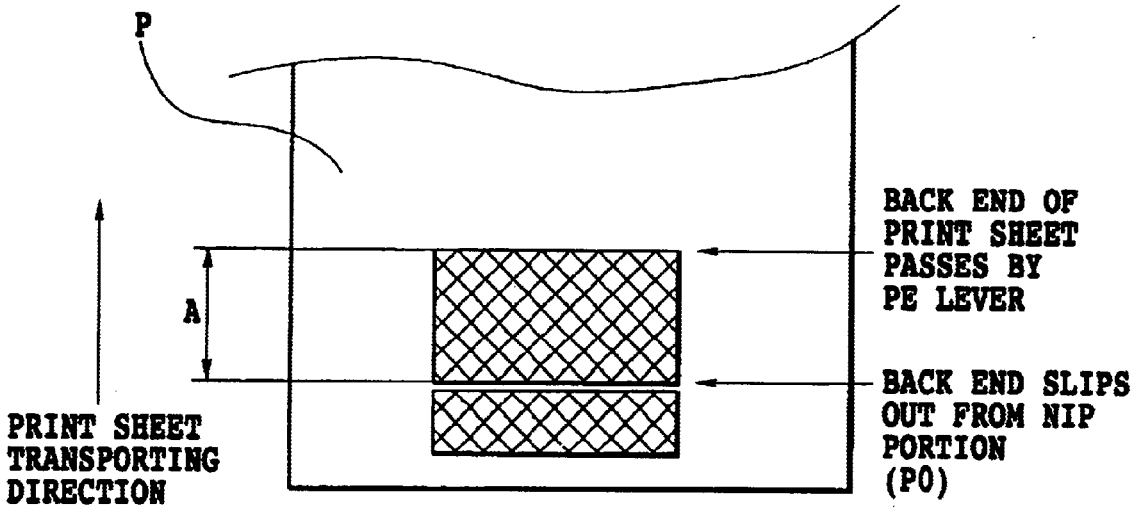
FIG. 9 is a plan view showing a test pattern formed according to the first embodiment of the present invention.

Further, the distance between the PE sensor lever and the nip 940 varies among printing apparatuses due to differences between parts or the like. Thus, in this embodiment, a test pattern such as the one shown in FIG. 9 is formed for each printing apparatus so that accurate nip position information can be obtained from this test pattern and written to an EEP (Electric Erasable Programmable) ROM (not shown) as a storage means.

The procedure of setting nip position information will be described below with reference to the flow chart in FIG. 10.

Figure 10:
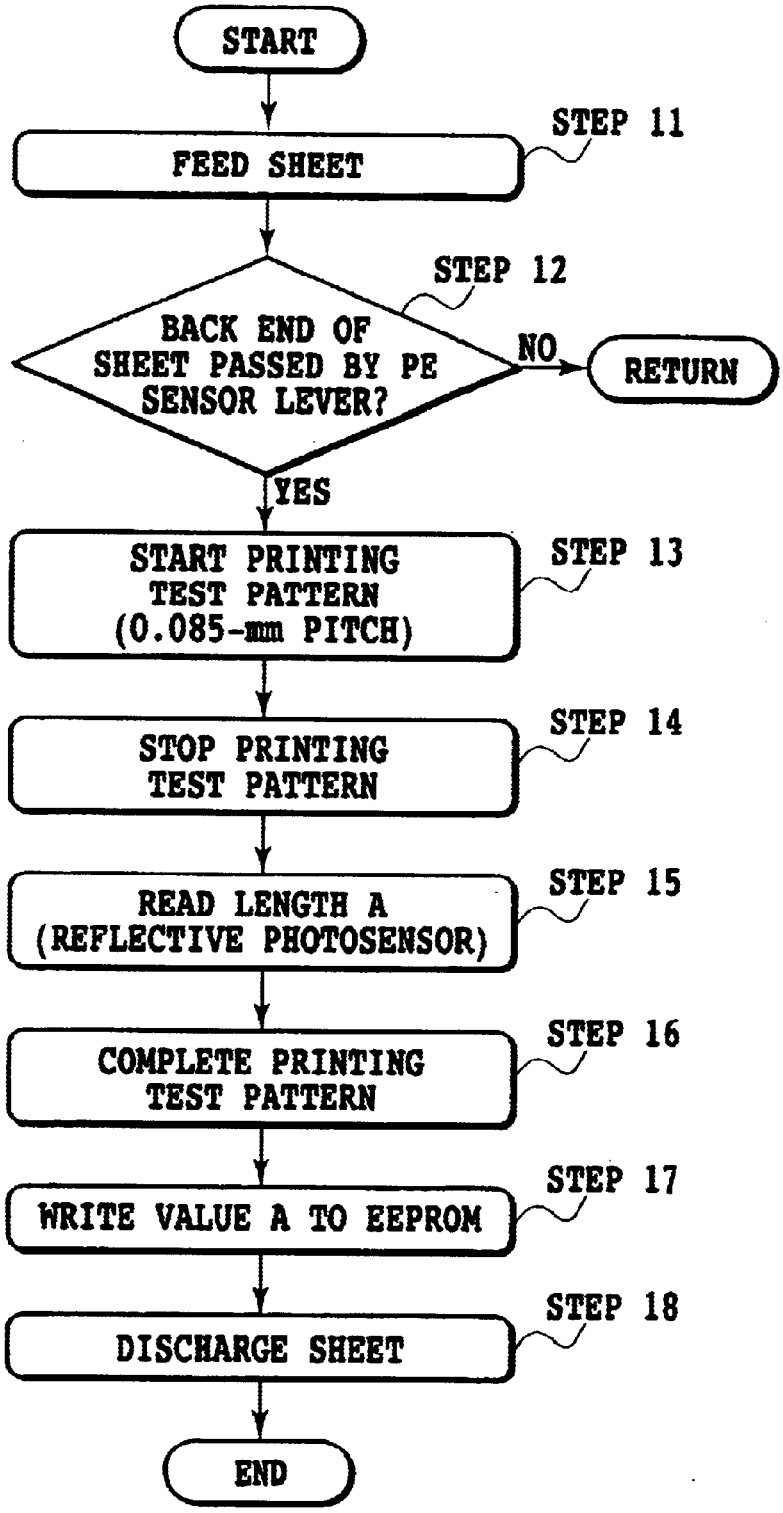
FIG. 10 is a flow chart showing an operation of obtaining and storing nip position information according to the first embodiment of the present invention.

In FIG. 10, first, at step 11, to form a test pattern, the automatic sheet feeding device performs a sheet feeding operation, and the transportation roller 36 and the sheet feeding roller 41 perform a transporting operation. During this transporting operation, when the back end of the print sheet P passes by the PE sensor lever 35 an operation of printing the test pattern is started (steps 12 and 13). The pattern to be formed is desirably an image that extends continuously in the transportation direction of the print sheet P. In this first embodiment, a black solid image is used which provides the largest contrast between a printed part and a non-printed part. The amount of sheet fed per operation in order to form this solid image is set at a very small value of about 0.085 mm (1/300 inch).

Immediately after the back end of the print sheet P has slipped out from the nip position 940 between the transportation roller 36 and the pinch roller 37, the transportation roller 36 and the sheet discharging roller 37 rotate a distance corresponding to the backlash of the gear train to feed the print sheet by a corresponding extra distance. Thus, a white stripe such as the one shown in FIG. 9 occurs in the black solid image as a test pattern. Subsequently, the printing operation is continued until the final row is printed on the print sheet P, and then the formation of the test pattern is completed (step 15).

During this printing operation, the print sheet P is fed to a reflective photosensor 970 provided downstream of the print heads 7. The photosensor 970 sequentially reads the printed test pattern and transmits read data to the control section. The control section receives a test pattern signal output from the photosensor 970 to read the distance A from a printing start position corresponding to the passage of the back end of the print sheet P by the PE sensor lever 940 to the end of the white stripe (non-printed part) P0, which indicates that the printed sheet P has slipped out from the nip portion 940. The distance A is then written to the EEPROM as positional information on the nip portion 940 which has been obtained using the PE sensor lever 35 as a reference position (step 17). The print sheet P on which the pattern has been entirely printed is discharged from the sheet discharging roller 41 to a sheet discharging tray (not shown) (step 18), thereby completing the series of operations.

As described previously, in this first embodiment, the test pattern is transported 0.085 mm per operation, thereby substantially avoiding errors in positional information obtained (distance A) to enable the nip position to be precisely set.

The nip position information thus obtained, which is unique to the printing apparatus, is stored in the storage means, so that during the subsequent printing operation, the position of the nip portion need not be detected for each print sheet using a sensor even if a plurality of print sheets are continuously printed. Thus, during the second and subsequent printing operations, it can be promptly and precisely determined whether or not the print sheet has slipped out from the nip, thereby accommodating a high-speed printing operation.

Further, the test pattern reader in the first embodiment is provided utilizing the transporting means of the printing apparatus, and is thus substantially implemented using the very inexpensive construction obtained simply by adding the photosensor to the transportation means. A reader having an arrangement separate from the printing apparatus may be used to read the test pattern. Alternatively, a human operator may measure the distance A in the test pattern formed on the print medium using a scale or another measuring instrument so that measured data can be written to the EEPROM.

In the example of the first embodiment, a black solid image is formed as a test pattern. However, the test pattern is not limited to a black solid image, but may be formed to have another color or shape. The pattern has only to be such that a non-printed part can be definitely distinguished from a printed part.

In this embodiment, the quantity of rotations of the transportation roller 36 is controlled by the signal from the encoder sensor 362. However, if the LF motor 88 comprises a pulse motor, the quantity of rotations of the transportation roller 36 may be controlled on the basis of the number of drive pulses.

Second Embodiment

In the first embodiment, individual nip position information obtained for each apparatus is obtained by printing the test pattern and reading the result of the printing. However, in this second embodiment, nip position information is obtained simply by transporting the sheet and without printing the test pattern or the like on the print sheet.

Figure 11:
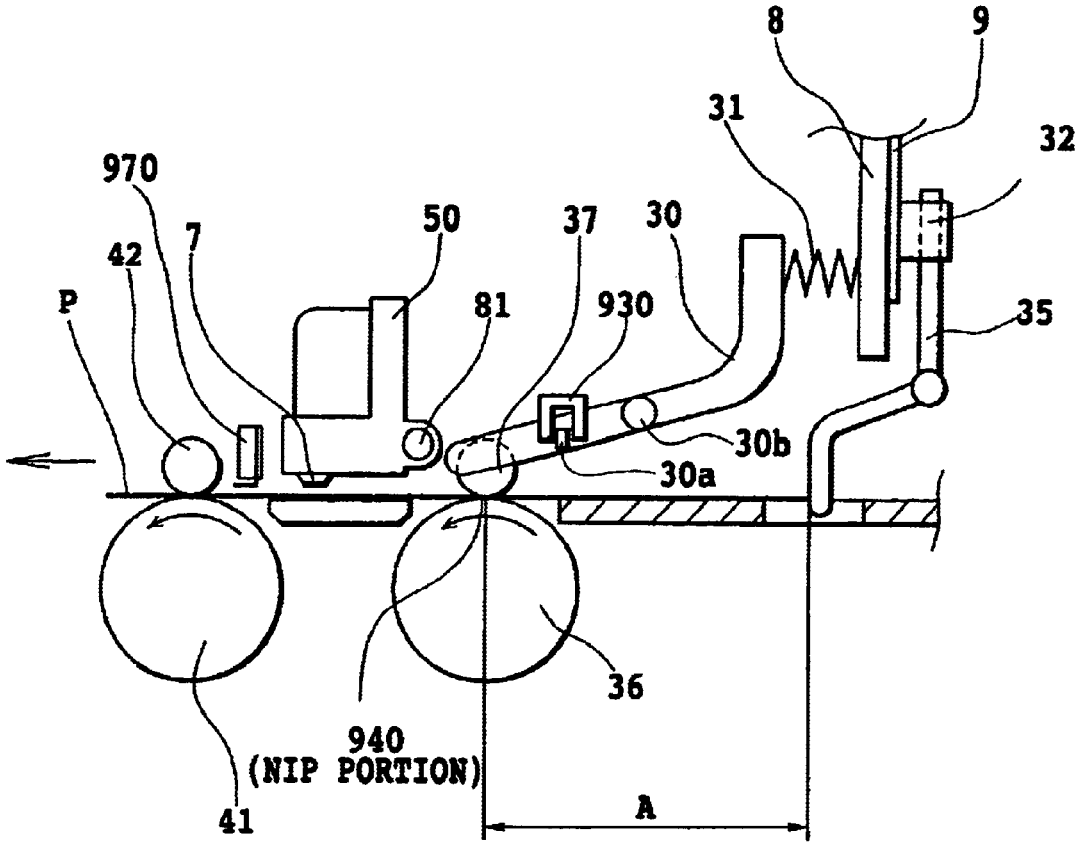
FIG. 11 is a side view schematically showing the construction of a second embodiment of the present invention.
Figure 12:
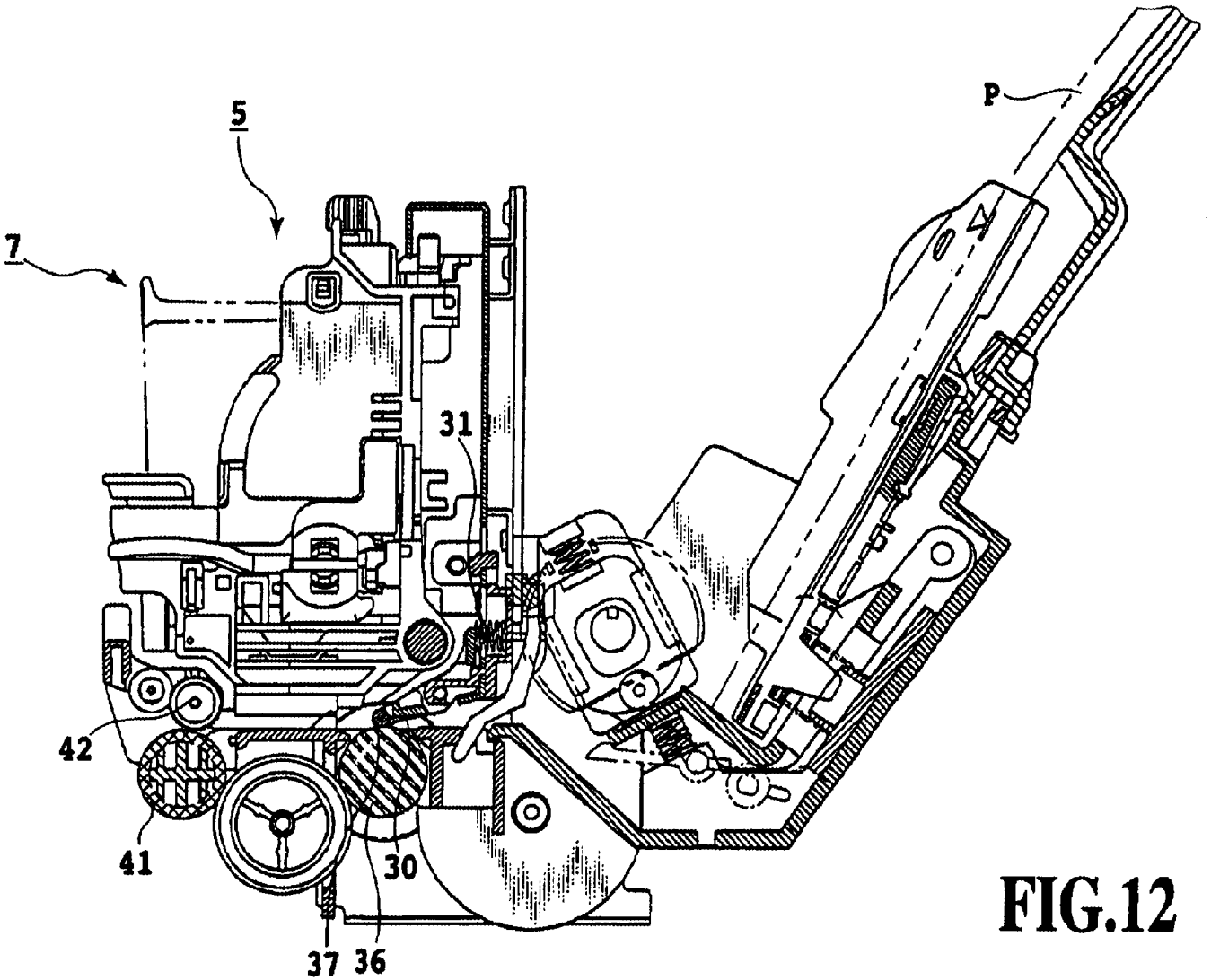
FIG. 12 is a vertical sectional side view showing a conventional printing apparatus.
Figure 13A:
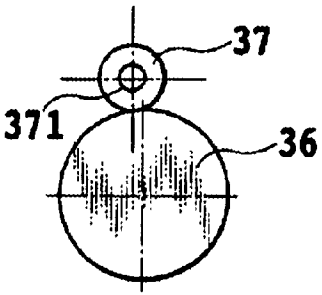
FIGS. 13A and 13B are views showing the relationship between a transportation roller and a pinch roller of the conventional printing apparatus.
Figure 13B:
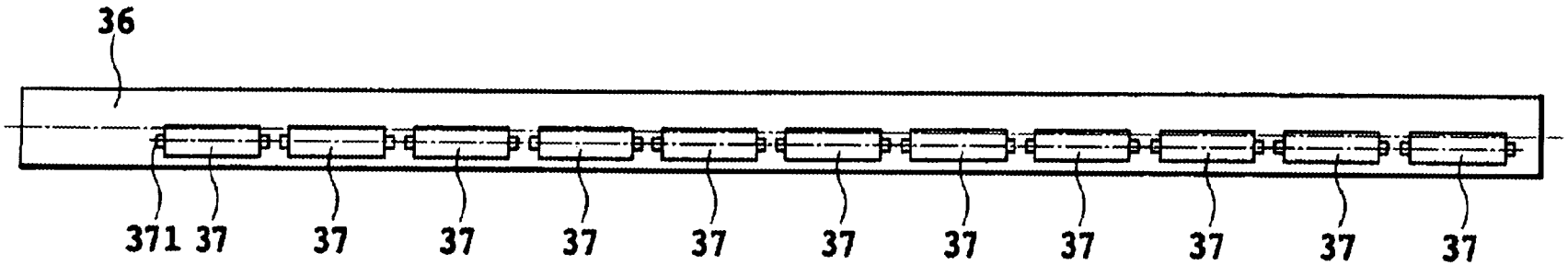

FIG. 11 schematically shows the construction of the second embodiment. As shown in the figure, in the second embodiment, a pinch roller sensor 930 detects a variation in the position of the pinch roller holder 30 so that whether or not the back end has slipped out from the nip is determined on the basis of the result of the detection. The pinch roller sensor 930 is composed of a photosensor 970 having a floodlighting section and a light receiving section disposed with a predetermined clearance provided therebetween. Further, the pinch roller holder 30, supported for rotational movements by a rotational-movement support point 30*b*, has a detected portion protruded from a side thereof. The detected portion 30*a* moves in between the floodlighting section and light receiving section of the pinch roller sensor 930 in accordance with rotational movement of the pinch roller holder 30.

If the print sheet P is transported while being sandwiched between the pinch roller and the transportation roller 36, the pinch roller 37 is raised by a distance corresponding to the thickness of the sheet, and the pinch roller holder 30 is correspondingly moved upward. In this state, the detected portion 30*a* is at such a position that it blocks an optical path between the floodlighting section and light receiving section of the pinch roller sensor 930. Accordingly, the light receiving section outputs a block signal (for example, an OFF signal). Upon receiving this block signal, the control section determines that the print sheet P is present at the nip 940 between the pinch roller 37 and the transportation roller 36.

Further, once the back end of the sheet has slipped out from the nip 840 between the pinch roller 37 and the transportation roller 36, the pinch roller 37 moves downward, and the pinch roller holder 38 correspondingly moves downward. As a result, the detected portion 30*a* of the pinch roller holder 38 recedes from the optical path between the floodlighting section and light receiving section of the pinch roller sensor 930. Then, the light receiving section receives light from the floodlighting section to output a light reception signal (for example, an ON signal).

Thus, in this second embodiment, whether or not the back end of the print sheet P has slipped out from the nip between the transportation roller 36 and the pinch roller 37 can be determined by detecting a change in the position of the pinch roller 37. Further, whether or not the back end of the print sheet P has reached the PE sensor lever 30, i.e., the reference position, can be detected on the basis of an output from the PE sensor 32 as in the case with the first embodiment, described previously.

Thus, the distance A is measured by counting the number of signals output by the encoder sensor 362 after the back end of the print sheet P has reached the PE sensor lever 30 and before it slips out from the nip between the transportation roller 36 and the pinch roller 37. Then, the distance A is automatically written to the EEPROM as in the case with the first embodiment, described previously, and is used for subsequent printing operations.

Although the print sheet P may be transported by intermittently repeating a very small amount of feeding as in the case with the first embodiment, described previously, the pinch roller sensor 930 can achieve more precise detection when the sheet is continuously transported at a very low speed. The other arrangements and operations are similar to those of the first embodiment, described previously.

Further, in this second embodiment, the print sheet P used to obtain nip position information has no image printed thereon, and can thus be reused for a printing operation, thereby more economically attaining the object of the invention. Furthermore, since no printing operation needs to be operated, the print sheet P can be continuously transported, thus obtaining more accurate nip position information.

Therefore, also in this second embodiment, the nip position information obtained can be used to form a high-grade image free from positional deviations.

Third Embodiment

In the above second embodiment, nip position information is obtained by detecting displacement of the pinch roller 37, but in a third embodiment, described below, effects similar to those of the above second embodiment are obtained by detecting a change in the state of rotation of the transportation roller 36.

That is, when the back end of the print sheet P slips out from the nip position 940 during a transportation operation, the transportation roller 36 rotates an extra distance according to the backlash as described previously. Thus, the encoder wheel 361 and the encoder sensor 362 are used to detect the quantity of rotations of the transportation roller during the intermittent transporting operation. If the detected quantity of rotations exceeds a normal value, it is determined that the back end of the print sheet P has slipped out from the nip portion. Then, nip position information (an interval A) can be obtained by counting the number of rotations after the PE sensor has detected the back end and before the print sheet P slips out from the nip portion.

Further, as a change in the state of rotation of the transportation roller 36, not only the quantity of rotations described above but also a change in the speed of rotation can be detected to determine the nip position. That is, when the back end of the print sheet P slips out from the nip portion, the speed of transportation increases above a normal value due to the pressure contact force of the pinch roller, and the speed of rotation of the transportation roller 36 also increases. Thus, the position of the nip portion within the transportation path can be detected by detecting the change in the speed of rotation of the transportation roller 36 by using the wheel and the encoder sensor 362.

As described above, in this third embodiment, the print sheet P is not subjected to test printing, and can thus be reused for a printing operation, thereby more economically attaining the object of the invention, as in the second embodiment. Furthermore, also in this case, the print sheet P can be continuously transported without performing a printing operation, thus obtaining more accurate nip position information.

In the above third embodiment, the state of rotation of the transportation roller 36 is detected. However, an encoder sensor that detects the rotary position of the sheet discharging roller 41 may be provided to detect the nip position by detecting a change in the quantity of rotations or the speed of rotation of the sheet discharging roller 41. Also in this case, effects similar to those of the above third embodiment are obtained.

In the examples of the above embodiments, the printing apparatus having the print heads based on the ink jet method, more specifically, what is called the bubble jet method, has been described by way of example. However, as is apparent from the description of the embodiments, the present invention is applicable to a printing apparatus having print heads of another kind. The ink ejecting method for the print heads may be a piezo method instead of the bubble jet method. Further, the present invention is applicable to a printing apparatus comprising print heads based on a printing method different from the ink jet method, for example, a thermal transfer method or another printing method in which the print heads each have print elements arranged therein.

The present invention has been described in detail with respect to preferred embodiments, and it will now be apparent from the foregoing to those skilled in the art that changes and modifications may be made without departing from the invention in its broader aspects, and it is the intention, therefore, in the appended claims to cover all such changes and modifications as fall within the true spirit of the invention.

What is claimed is:

1. A printing apparatus using a printing means that executes printing on a print medium transported along a transportation path, said apparatus comprising:

upstream transporting means including a transportation roller driven by a driving means and a pinch roller, arranged upstream of the printing means in the transportation path for transporting the print medium by rotating while sandwiching the print medium at a nip portion;

downstream transporting means arranged downstream of the printing means in the transportation path for transporting the print medium;

information obtaining means for obtaining nip position information, said information obtaining means comprising rotation state detecting means for detecting a state of rotation of said transportation roller in a state in which the print medium is sandwiched between said transportation roller and said pinch roller at the nip portion thereof and in a state in which the print medium has passed out from the nip portion, and measuring means for measuring an interval between a predetermined reference position located upstream of the nip portion in the transportation path and the nip portion, on the basis of a result of detection by said rotation state detecting means; and storage means for storing the nip position information obtained by said information obtaining means.

2. A printing apparatus as claimed in claim 1, wherein said downstream transporting means comprises a sheet discharging roller located downstream of the printing means in the transportation path and driven by predetermined driving means and a spur that is urged toward said sheet discharging roller.

3. A printing apparatus as claimed in claim 1, wherein said nip position information is set on the basis of a test pattern formed on the print medium by said printing means and said transportation means using printing data for forming an image that extends continuously in a transportation direction of said print medium.

4. A printing apparatus as claimed in claim 3, wherein said nip position information is set on the basis of an interval between a predetermined reference position in said test pattern and a leading end of a discontinuous portion.

5. A printing apparatus as claimed in claim 3, wherein when said test pattern is printed, said transporting means transports said print medium 1 mm or less during a single operation when a back end of said print medium is near said nip portion.

6. A printing apparatus as claimed in claim 3, further comprising information obtaining means for automatically obtaining said nip position information, the information obtaining means comprising a photosensor that reads a printed part and a non-printed part both formed in the test pattern and means for measuring the interval between the predetermined reference position in the printed part of the test pattern and the leading end of the non-printed part, on the basis of an output signal from a photosensor.

7. A printing apparatus as claimed in claim 3, wherein during an image forming operation performed immediately after the back end of said print medium has slipped out from said nip position, a correcting operation is performed which shifts an operative part of said printing means in the transportation direction compared to an image forming operation performed immediately before the back end slips out from the nip portion, while increasing the quantity of transportation by the transporting means.

8. A printing apparatus as claimed in claim 1, further comprising information obtaining means for automatically obtaining said nip position information, the information obtaining means comprising roller displacement detecting means for detecting displacement of the pinch roller between a state in which the print medium is sandwiched between the transportation roller and the pinch roller at the nip portion thereof and a state in which the print medium has slipped out from said nip portion, and means for measuring the interval between a predetermined reference position located upstream of said nip portion in the transportation path and said nip portion, on the basis of a result of detection by the roller displacement detecting means.

9. A printing apparatus as claimed in claim 1, wherein said rotation state detecting means detects a change in the speed of rotation of said transportation roller.

10. A printing apparatus as claimed in claim 1, wherein said rotation state detecting means detects a change in the quantity of rotations during each intermitent rotating operation of said transportation roller.

11. A printing apparatus as claimed in claim 1, wherein said rotation state detecting means comprises an optical code wheel that rotates around the same center of rotation as that of said transportation roller, and a sensor that reads a signal from said optical code wheel.

12. A printing apparatus as claimed in claim 1, wherein said printing means uses thermal energy to generate bubbles in ink so that energy generated by the bubbles can cause the ink to be ejected.

13. A printing method for executing printing on a print medium transported along a transportation path by using printing means, said printing method comprising the steps of:

transporting the print medium by upstream transporting means including a a transportation roller and a pinch roller, arranged upstream of the printing means in the transportation path while sandwiching the print medium at a nip portion;

transporting the print medium by downstream transporting means arranged downstream of the printing means in the transportation path;

storing nip position information representative of a position of the nip portion between the transportation roller and the pinch roller within the transportation path, wherein the nip position information relates to an interval between a predetermined reference position located upstream of the nip portion in the transportation path and the nip portion; and an information obtaining step of obtaining the nip position information, the information obtaining step comprising a rotation state detecting step of detecting a state of rotation of the transportation roller between a state in which the print medium is sandwiched between the transportation roller and the pinch roller at the nip portion thereof and a state in which the print medium has passed out from the nip portion, and a step of measuring the interval between a predetermined reference position located upstream of the nip portion in the transportation path and the nip portion, on the basis of a result of detection by said rotation state detecting step.

14. A printing method as claimed in claim 13, wherein said nip position information is set on the basis of a test pattern formed on the print medium by said printing means and said transportation means using printing data for forming an image that extends continuously in a transportation direction of said print medium.

15. A printing method as claimed in claim 14, wherein said nip position information is set on the basis of an interval between a predetermined reference position in said test pattern and a leading end of a discontinuous portion.

16. A printing method as claimed in claim 14, wherein when said test pattern is printed, said transporting means transports said print medium 1 mm or less during a single operation when a back end of said print medium is near said nip portion.

17. A printing method as claimed in claim 14, comprising an information obtaining step of automatically obtaining said nip position information, the information obtaining step comprising the steps of reading a printed part and a non-printed part both formed in the test pattern and measuring the interval between the predetermined reference position in the printed part of the test pattern and the leading end of the non-printed part, on the basis of an output signal from a photosensor.

18. A printing method according to claim 14, wherein during an image forming operation performed immediately after the back end of said print medium has slipped out from said nip position, a correcting operation is performed which shifts an operative part of said printing means in the transportation direction compared to an image forming operation performed immediately before the back end slips out from the nip portion, while increasing the quantity of transportation by the transporting means.

19. A printing method as claimed in claim 13, comprising an information obtaining step of automatically obtaining said nip position information, the information obtaining step comprising a roller displacement detecting step of detecting displacement of the pinch roller between a state in which the print medium is sandwiched between the transportation roller and the pinch roller at the nip portion thereof and a state in which the print medium has slipped out from said nip portion, and a step of measuring the interval between a predetermined reference position located upstream of said nip portion in the transportation path and said nip portion, on the basis of a result of detection by the roller displacement detecting step.

20. A printing method according to claim 13, wherein said rotation state detecting step detects a change in the speed of rotation of the transportation roller.

21. A printing method according to claim 13, wherein said rotation state detecting step detects a change in the quantity of rotations during each intermittent rotating operation of the transportation roller.

22. A printing apparatus having printing means that executes printing on a print medium transported along a transportation path, said apparatus comprising:

upstream transporting means arranged upstream of the printing means in the transportation path for transporting the print medium, said upstream transporting means comprising a transportation roller driven by predetermined driving means and a pinch roller cooperatively sandwiching the print medium between said pinch roller and said transporting roller;

downstream transporting means arranged downstream of the printing means in the transportation path for transporting the print medium;

first detecting means arranged upstream of said upstream transporting means to detect the print medium passing through a predetermined position;

second detecting means for detecting the print medium passing through a nip portion between said transportation roller and said pinch roller;

measuring means for measuring a transported distance after an end of the print medium passes through the predetermined position until it passes through said upstream transporting means based on results detected by said first detecting means and said second detecting means; and storage means for storing information related to the transported distance after the end of the print medium passes through the predetermined position until it passes through said upstream transportation means based on a result measured by said measuring means.

23. A printing apparatus as claimed in claim 22, wherein said second detecting means detects an increase in a rate of the number of rotations of said transportation roller to a driving amount of said driving means.

24. A printing apparatus as claimed in claim 22, further comprising control means controlling storage of the driving amount of said driving means to said storage means as the information of the transported distance after said first detecting means detects the print medium passing through the predetermined position until said second detecting means detects the print medium passing through said nip portion between said transportation roller and said pinch roller.

25. A printing apparatus having printing means that executes printing on a print medium transported alone a transportation path, said apparatus comprising:

upstream transporting means arranged upstream of the printing means in the transportation path for transporting the print medium, said upstream transporting means comprising a transportation roller driven by predetermined driving means and a pinch roller cooperatively sandwiching the print medium between said pinch roller and said transporting roller;

downstream transporting means arranged downstream of the printing means in the transportation path for transporting the print medium;

first detecting means arranged upstream of said upstream transporting means to detect the print medium passing through a predetermined position;

second detecting means for detecting the print medium passing through a nip portion between said transportation roller and said pinch roller; and storage means for storing information related to a transported distance after an end of the print medium passes through the predetermined position until it passes through said upstream transporting means, wherein said second detecting means detects a temporary increase of rotation speed of said transportation roller.

26. A printing apparatus comprising:

a transportation roller to be driven by driving means through a gear train;

a pinch roller which sandwiches a print medium between said pinch roller and said transportation roller in a cooperative manner;

printing means for performing printing onto the print medium, said printing means being placed downstream of said transportation roller in a transportation path;

transporting means for transporting the printing medium, said transporting means being placed downstream of said printing means in the transportation path;

control means for controlling said transportation roller and said transporting means to repeat a drive of and a stop after transportation of a predetermined transportation amount by turns, and for further controlling said printing means to perform printing while said transportation roller is in a stop condition;

detecting means for detecting an end of the print medium passing through a predetermined position upstream of said transportation roller; and storage means for storing an interval between the predetermined position and a nip portion between said transportation roller and said pinch roller, wherein said control means controls said driving means such that, while transporting by the predetermined transportation amount, when a transportation amount after the end of the print medium is detected by said detecting means exceeds a distance stored in said storage means, an excessive transportation amount of transporting the printing medium beyond a transportation amount caused by idling of said transportation roller due to a backlash of said gear train when the end of the print medium passes through the nip between said transportation roller and said pinch roller in addition to the predetermined transportation amount is effected, thereby performing printing of a position continuous to an image previously printed by said printing means.

27. A printing apparatus as claimed in claim 26, wherein said printing means has a plurality of ejection ports for ejecting ink, and said controlling means controls to eject ink from said ejection ports selected for printing on a position corresponding to a transported amount of the print medium after an end of the print medium passes through the nip position between said transportation roller and said pinch roller.

* * * * *

UNITED STATES PATENT AND TRADEMARK OFFICE

CERTIFICATE OF CORRECTION

PATENT NO. : 6,761,425 B2
DATED : July 13, 2004
INVENTOR(S) : Kawaguchi et al.

It is certified that error appears in the above-identified patent and that said Letters Patent is hereby corrected as shown below:

Column 5,
Line 34, "(see Fig. 2)" should read -- (see Fig. 2). --.

Column 6,
Line 52, "determined" should read -- determined when --.

Column 8,
Line 46, "sheet" should read -- sheet. --.

Column 16,
Line 21, "a" (second occurrence) should be deleted.

Column 18,
Line 12, "alone" should read -- along --.

Signed and Sealed this

Fifth Day of April 2005

JON W. DUDAS
*Director of the United States Patent and Trademark Office*